US006370443B2

(12) United States Patent
Kim

(10) Patent No.: US 6,370,443 B2
(45) Date of Patent: Apr. 9, 2002

(54) EMBROIDERY MACHINE WITH OPERATION-DATA STORING FUNCTION AND METHOD FOR CONTROLLING SAME

(75) Inventor: Do Wan Kim, Inchon (KR)

(73) Assignee: Hankuk Special Precision Co., Ltd., Inchon (KR)

( * ) Notice: Subject to any disclaimer, the term of this patent is extended or adjusted under 35 U.S.C. 154(b) by 0 days.

(21) Appl. No.: 09/788,233

(22) Filed: Feb. 16, 2001

(30) Foreign Application Priority Data

Feb. 18, 2000 (KR) ..... 2000-7897

(51) Int. Cl.[7] ..... G06F 19/00; D05B 19/12

(52) U.S. Cl. ..... 700/138; 112/102.5; 112/475.19

(58) Field of Search ..... 700/138, 136, 700/137; 112/102.5, 470.04, 470.06, 475.19, 453, 454, 456, 457, 458

(56) References Cited

U.S. PATENT DOCUMENTS 5,029,539 A * 7/1991 Yokoe et al. ..... 112/102.5
5,359,949 A 11/1994 Asano
6,119,611 A * 9/2000 Tomita ..... 700/138 X
6,123,037 A 9/2000 Shimizo
6,209,467 B1 * 4/2001 Tomita ..... 700/138 X

* cited by examiner

*Primary Examiner*—Peter Nerbun
(74) *Attorney, Agent, or Firm*—Akin, Gump, Strauss, Hauer & Feld, L.L.P.

(57) ABSTRACT

The embroidery machine includes: 1) a function-setting unit (110) having a current-operation data storing key for storing current-operation data and an operation data retrieval key for retrieving stored previous-operation data; 2) an operation data storage unit (120) for storing data with respect to the current operation in response to a signal generated by the selection of the operation-data storing key at the function-setting unit (110); and 3) a control unit (130) for controlling storage of the current-operation data in the operation data storage unit (120), checking whether there exist an operation stored in the operation data storage unit (120) if the operation data retrieval key is selected at the function-setting unit (110), and controlling the performance of the corresponding embroidery operation as a result of the check.

9 Claims, 4 Drawing Sheets

EMBROIDERY MACHINE WITH OPERATION-DATA STORING FUNCTION AND METHOD FOR CONTROLLING SAME

BACKGROUND OF THE INVENTION

The present invention relates to an embroidery machine, and more particularly to an embroidery machine with an operation-data storing function for storing data of a currently performing embroidery operation, and a method for controlling the embroidery machine.

In general, an industrial embroidery machine refers to a mechanical apparatus for embroidering a desired pattern by moving the embroidery frame, into which an embroidery cloth is fixed, in the X-axis or Y-axis direction, while a needle holder of a sewing machine which performs a sewing operation moves up and down.

The embroidery machine is designed to embroider on an embroidery cloth by moving the embroidery frame into which the embroidery cloth is fixed in the X or Y direction. Accordingly, the precision in movement and lower vibration of the embroidery frame are closely involved with the quality of embroidery.

An AC servo motor, or an induction motor whose speed is controllable is used as a power source for driving the needle holder of the embroidery machine, and a stepping motor which has an excellent positioning capability and is easy to control is used as a power source for driving the embroidery frame in the X or Y direction.

Usually, there are 12 to 24 sewing machines coupled with one shaft in order to improve embroidery productivity. Each sewing machine has 6 to 12 needle holders for embroidering with threads of various colors according to embroidery designs, and a thread of different color is held in each needle holder.

These days, users seek an embroidery machine which provides not only easy input, copy, and storage but also simple edit of embroidery designs, and so on. Furthermore, users favor an automated embroidery machine with an automatic thread-color change function according to embroidery designs, a thread-cut function for cutting threads automatically after completion of an embroidery operation, an alarm function for stopping th e embroidery machine and displaying an alarm when a thread is broken, a power-outage recovery function for continuing the embroidery operation when the embroidery machine is stopped due to power outage, and the like.

In addition to efforts to improve the quality of embroidery, the manufacturers of embroidery machines adopt an industrial computer or a microcomputer into the embroidery machine so as to meet the desires of the users who favor a multi-function embroidery machine. FIG. 1 shows a schematic block diagram of such a conventional embroidery machine.

As shown in the FIG. 1, the conventional embroidery machine comprises a function-setting unit 10 with function selection keys for setting various functions, a control unit 20 for generally controlling the embroidery machine with a memory stored with software programs necessary for the control of the embroidery machine, and a mechanism unit 30 for driving the needle holders and the embroidery frame according to the control of the control unit 20. Furthermore, the control unit 20 may include a set-up data storage unit 40 for storing various set-up data to perform the embroidery operation (parameter data for driving the mechanism unit, such as embroidery operation speed, needle-holder selection data, etc.), and an internal or external embroidery design storage unit 50 for storing embroidery design data, while FIG. 1 shows an embodiment of the embroidery machine with an external one.

The operation of the embroidery machine with such configuration is described with FIG. 2 as follows.

First, a user selects a desired embroidery design among the embroidery designs stored in the embroidery design storage unit 50, and sets the set-up data for performing the embroidery operation (parameter data for driving the mechanism unit, such as an embroidery operation speed, needle-holder selection data, etc.) through the function-setting unit 10 in a step S1. Then, the control unit 20 checks whether a start key for starting the embroidery operation is selected at the function-setting unit 10 in a step S2. Subsequently, the control unit 20 drives the mechanism unit 30 in a step S3, according to the parameter data set at the step S1 if the start key is selected as a result of such a check.

Next, the control unit 20 reads embroidery data for the embroidery design selected by the user from the embroidery design storage unit 50 in a step S4. Then, the control unit 20 determines whether the read-out embroidery data is an end code in a step S5. After such a determination, the control unit 20 stops the drive of the mechanism unit 30 so as to perform a principal-axis stop routine for stopping the drive of the needle holders and the embroidery frame in a step S6, then ends the embroidery operation.

Alternatively, the control unit 20 checks whether a stop key is selected if the embroidery data read-out at the step S5 is not an end code in a step S7. The embroidery operation is performed if the stop key is not selected after such a check of a stop key selection in a step S8. On the contrary, if the stop key is selected, the drive of the mechanism unit 30 is caused to stop so as to perform the principal-axis stop routine for stopping the needle holders and the embroidery frame in a step S9. Then, it is determined whether the start key is selected from the function-setting unit 10 in a step S10.

If the start key is selected as a result of the determination at the step S10, the step S3 is followed and the embroidery operation is caused to perform. On the contrary, if the start key is not selected from the function-setting unit 10, the control unit 20 checks whether the operation end key is selected in a step S11, and ends the embroidery operation when the operation end key is selected. In the meanwhile, if the operation end key is not selected, the step S10 is followed subsequently, and it is checked whether the start key is selected repeatedly.

In such a conventional embroidery machine, a user has to wait until a currently performing embroidery operation is over or cancels the embroidery operation, in case of an unexpected urgent operation during an embroidery operation after reading a desired embroidery design from the embroidery design storage unit 50.

For instance, if the amount of the remaining work to complete the current embroidery operation is 30,000 stitches, the user has to wait about 35 minutes to complete the current embroidery operation for the urgent embroidery operation even when the operation speed is 850 rpm. Furthermore, it has other inconveniences such as a customer service representative for repair and maintenance must wait until the current embroidery operation is over when the service representative visits the user during an operation.

BRIEF SUMMARY OF THE INVENTION

The present invention is designed to overcome such problems, and therefore it is an object of the present invention to provide an embroidery machine with an operation-data storing function for storing data of a currently performing embroidery operation when there is another urgent embroidery operation that needs to be carried out before completing the currently performing embroidery operation, performing the urgent embroidery operation, and subsequently resuming the stored embroidery operation, and a method for controlling the embroidery machine.

In order to accomplish the above object, the present invention provides an embroidery machine with an operation-data storing function comprising: 1) a function-setting means having an operation-data storing key for outputting a signal to store current-operation data as previous-operation data according to user manipulation, and/or an operation data retrieval key for outputting a signal to read the stored previous-operation data; 2) an operation data storage means for storing data with respect to the previous operation; and 3) a control means for storing the current-operation data as the previous-operation data of the embroidery machine when the signal from the function-setting means to store the current-operation data as the previous-operation data is inputted, and reading the previous-operation data stored in the operation data storage means when the signal from the function-setting means to read the previous-operation data is inputted, so as to drive a corresponding mechanism means.

In order to accomplish the above object, the present invention provides a method for controlling an embroidery machine with an operation-data storing function, the method comprising: 1) checking whether previous-operation data is being stored in a storage means in response to a signal for reading the previous-operation data when the signal is inputted according to manipulation of a function-setting means by a user, and 2) controlling a read-out of the previous-operation data and the drive of the embroidery machine according to the previous-operation data if the previous-operation data is being stored in the storage means corresponding to the signal for reading the previous-operation data inputted by the user.

BRIEF DESCRIPTION OF SEVERAL VIEWS OF THE DRAWINGS

The above and other objects and features of the instant invention will become apparent from the following description of preferred embodiments taken in conjunction with the accompanying drawings, in which.

DETAILED DESCRIPTION OF THE INVENTION

Hereinafter, preferred embodiments of the present invention will be described in detail with reference to the accompanying drawings.

Figure 1:
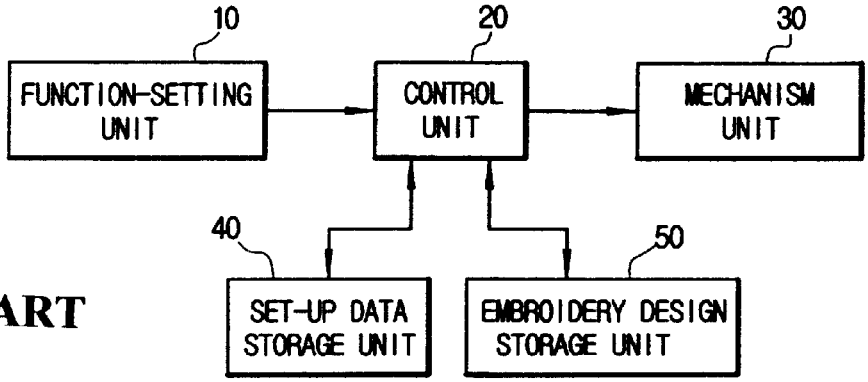
FIG. 1 is a prior art schematic block diagram of a conventional embroidery machine.
Figure 3:
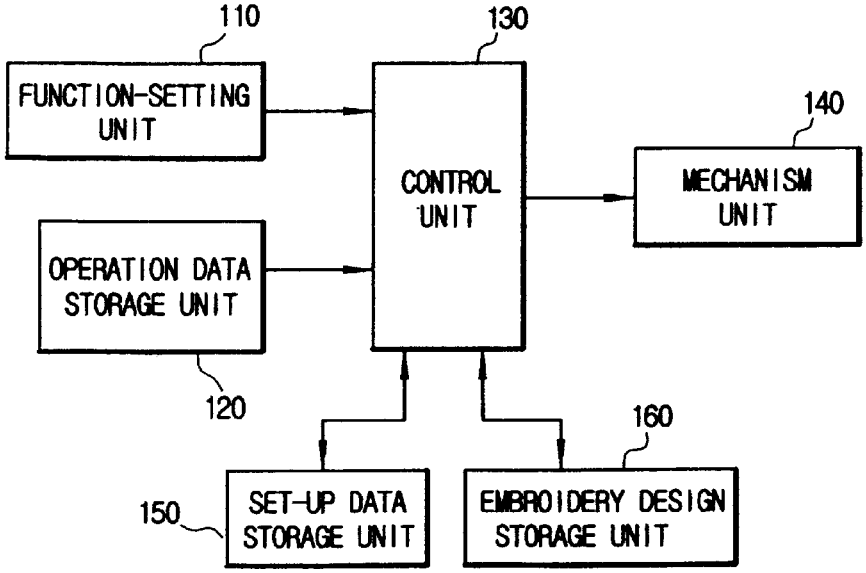
PRIOR ART FIG. 3
FIG. 3 is a schematic block diagram of an embroidery machine with an operation-data storing function according to the invention.
Figure 2:
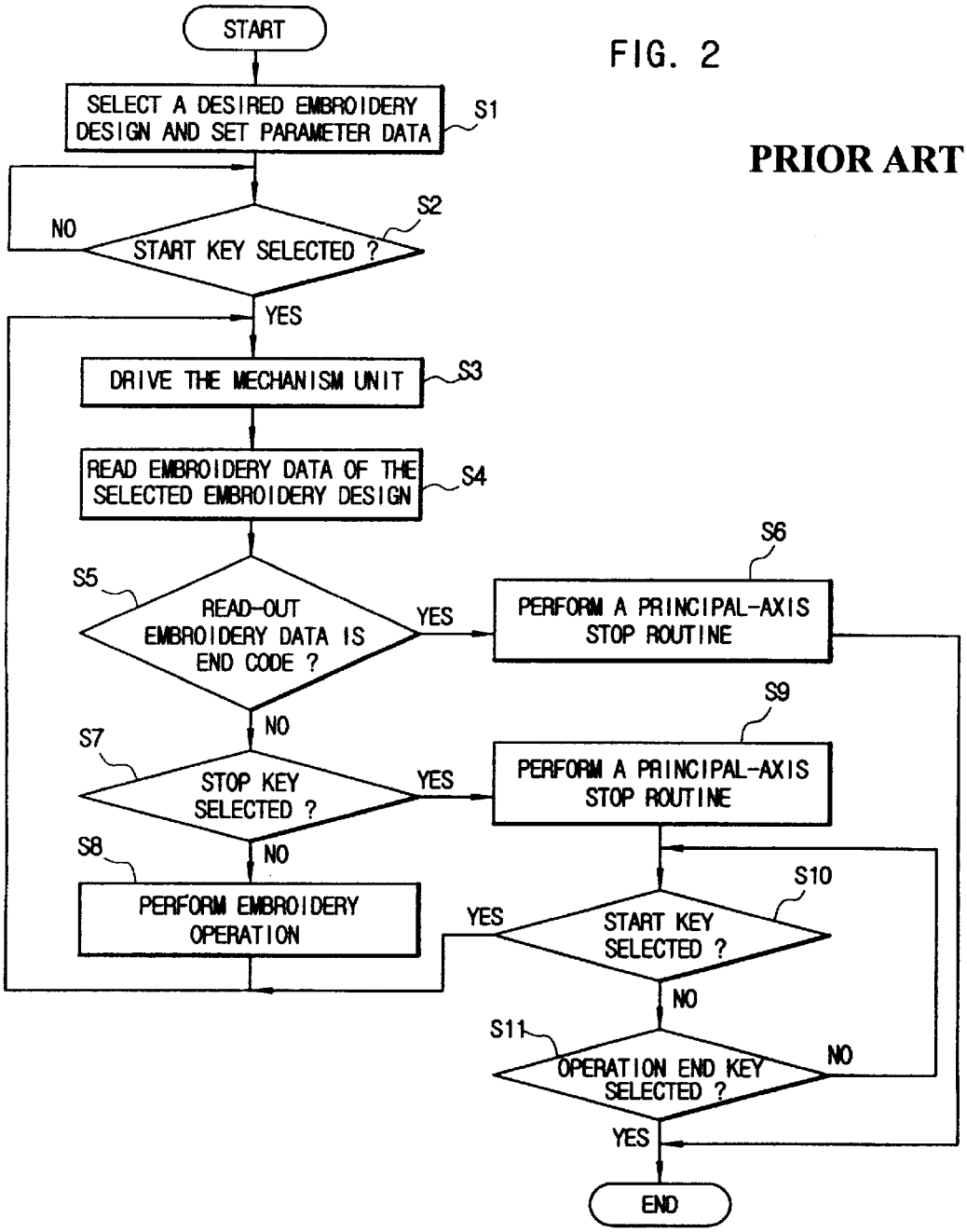
FIG. 2 PRIOR ART
FIG. 2 is an operation flowchart of the embroidery machine of FIG. 1.

FIG. 3 shows a block diagram of an embroidery machine with an operation-data storing function according to the present invention. The embroidery machine of the invention comprises a function-setting unit 110, an operation data storage unit 120, and a control unit 130. The function-setting unit 110 includes an operation-data storing key for storing current-operation data as previous-operation data, an operation data retrieval key for retrieving operation data of a previously performed embroidery operation, and other function selection keys. And, the operation data storage unit 120 is stored with the previous-operation data. The control unit 130 controls storage of the current-operation data as previous-operation data in the operation data storage unit 120, when the operation-data storing key of the function-setting unit 110 is selected by the user and accordingly a signal for storing the operation data is inputted. Furthermore, the control unit 130 checks whether there exist previous-operation data stored in the operation data storage unit 120 when the operation data retrieval key of the function-setting unit 110 is selected by the user and accordingly the signal for reading the previous-operation data is inputted. Then, the control unit 130 drives a mechanism unit 140 so as to perform a corresponding embroidery operation as a result of the check. In addition, the control unit 130 controls general operation of the embroidery machine according to the setting of the various function selection keys of the function-setting unit 110.

There is provided a flash memory capable of keeping stored data even in the event of a power off condition, or a battery-loaded random access memory (RAM or NVRAM: Non-Volatile RAM) for the operation data storage unit 120. Alternatively, it is possible to incorporate a battery into the RAM so as to keep the stored data. The previous-operation data stored in the operation data storage unit 120 include a design name of the previous operation, a position of the design data in the memory, position data of the embroidery frame, a total stitch number of the current operation, various parameter data for driving the current mechanism unit (such as an embroidery operation speed, needle holder data, etc.), and so on.

The control unit 130 may consist of a microcomputer, or the like, and the function of the mechanism unit 140 is the same as the conventional one. The control unit 130 includes a set-up data storage unit 150 for storing various set-up data (parameter data for driving the mechanism unit, such as the embroidery operation speed, the needle holder selection data, etc.) to perform the embroidery operation the same as the conventional one, and an internal or external embroidery design data storage unit 160 for storing various embroidery design data, while FIG. 3 shows an example of the control unit 130 with an external one.

Figure 4A:
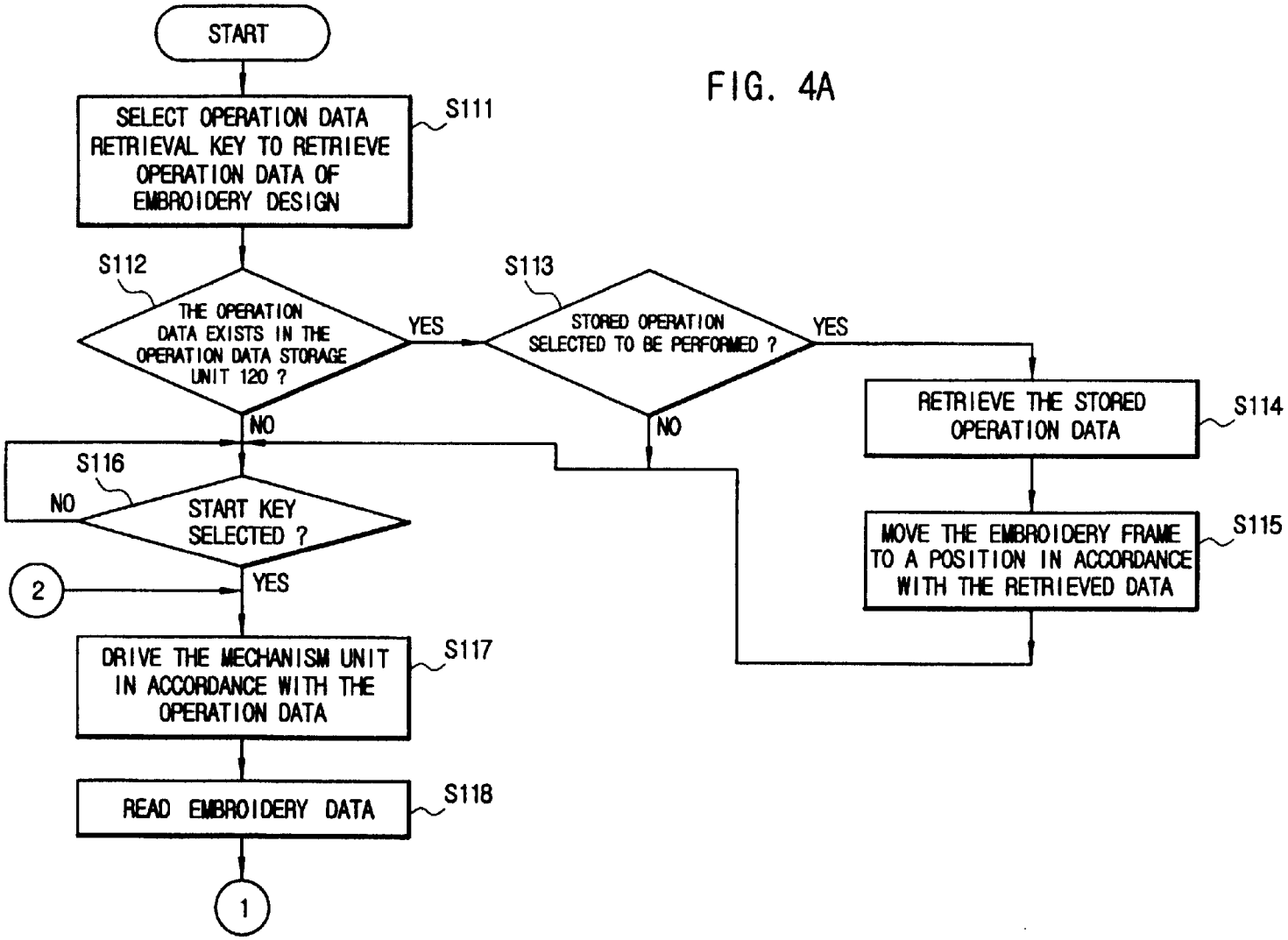
FIGS. 4A and 4B show an operation flowchart illustrating a method for controlling the embroidery machine of FIG. 3.
Figure 4B:
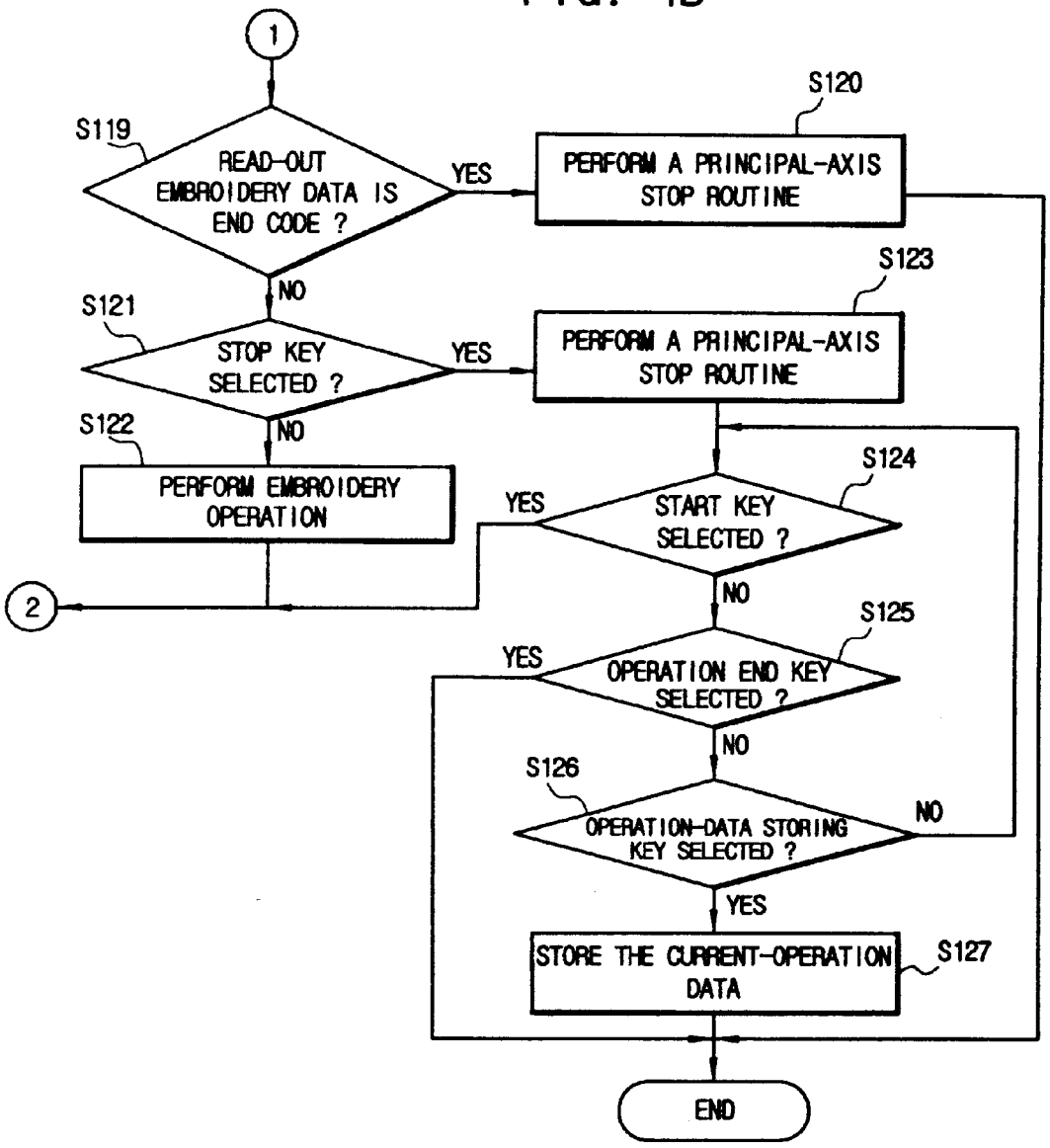

The invention having such configuration as set forth above is described with FIGS. 4A and 4B as follows.

First, a user selects the operation data retrieval key of the function-setting unit 110 in order to retrieve operation data of a previously performed embroidery design in a step S111. Then, the control unit 130 checks whether there exist the corresponding operation data in the operation data storage unit 120 in a step S112. Also, various data required for performing the embroidery operation can be set through the function-setting unit 110 in the step S111 .

As a result of the check in the step S112, the user can select whether to perform the embroidery operation corresponding to the stored operation data if the operation data exist in a step S113. Next, the operation data stored in the operation data storage unit 120 is retrieved if the user selects to perform the stored operation in a step S114, then the embroidery frame is caused to move to the position in accordance with the retrieved data in a step S115. Then it is checked whether the user selects a start key of the function-setting unit 110 and correspondingly a start signal is inputted in a step S116.

If the start signal is inputted from the function-setting unit 110 as a result of the check in the step S116, the control unit 130 drives the mechanism unit 140 in a step S117 in accordance with the previous operation data retrieved in the step S114. Accordingly, the control unit 130 reads embroidery data in a step S118, and checks whether the embroidery data is an end code in a step S119.

While, if there exists no stored operation as a result of the check in the step S112 or the user does not select the stored operation to be performed in the step S113, it is checked whether the user selects the start key and accordingly the start signal is inputted in the step S116. If the start signal is inputted, the control unit 130 drives the mechanism unit 140 in accordance with the data set in the step S111, and reads the embroidery data so as to check whether the read-out embroidery data is an end code.

If the embroidery data is an end code at the check result in the step S119, the mechanism unit 140 is controlled to perform the principal-axis stop routine for stopping the needle holder and the embroidery frame in a step S120, and ends the operation.

On the contrary, if the embroidery data is not an end code at the check result in the step S119, the control unit 130 checks whether the user selects the stop key at the function-setting unit 110 and accordingly the stop signal is inputted in a step S121. If no stop signal is inputted at the check result in the step S121, the embroidery operation is performed in a step S122. Otherwise, if the stop signal is inputted at the check result in the step S121, the control unit 130 stops the drive of the mechanism unit 140 so as to perform the principal-axis stop routine for stopping the needle holders and embroidery frame in a step S123. Then, it is checked whether the user selects the start key of the function-setting unit 110 and accordingly the start signal is inputted in a step S124.

If the start signal is inputted at the check result in the step S124, the step S117 is followed and the embroidery operation is performed. On the contrary, if the start signal is not inputted, it is checked whether the user selects the operation end key of the function-setting unit 110 and accordingly the operation end signal is inputted in a step S125. If the operation end signal is inputted, the control unit 130 ends the embroidery operation, otherwise, the operation end signal is not inputted, the control unit 130 checks whether the user selects the operation-data storing key so as to input an operation-data storing signal for storing the current-operation data as previous-operation data in a step S126.

If the operation-data storing signal is inputted from the function-setting unit 110, the control unit 130 stores the current-operation data, such as a design name of the operation, a position of the design data in the memory, position data of the embroidery frame, a total stitch number of current operation, various parameter data for driving the mechanism unit, etc. of the currently performing embroidery operation as the previous-operation data in the operation data storage unit 120 in step S127, and ends the embroidery operation. Otherwise, if the operation-data storing signal is not inputted, the step S124 is followed and it is checked whether the start signal is inputted repeatedly.

In the present invention having such configuration, users can select the operation-data. storing key in the function-setting unit 110 for storing the current-operation data as the previous-operation data in order to store the current-operation data, when an embroidery operation is stopped during the operation, such as incidental thread breakage or an operation stop key input, etc. Then, the current-operation data such as a design data name, a stored position of the design data in the memory, position data of the embroidery frame, a total stitch number of current operation, various parameter data for driving the mechanism unit (such as the embroidery operation speed, the needle holder selection data, etc.) or the like of the currently performing operation are stored as the previous-operation data in the operation data storage unit 120, and the operation is finished.

Furthermore, the user can check the operation data stored in the operation data storage unit 120 through the operation data retrieval key of the function-setting unit 110 after completing an urgent embroidery operation, and can select whether to perform the stored operation. If the user selects to perform the stored operation, the user can resume the previous embroidery operation by causing the embroidery frame to move to a corresponding operation position in accordance with the operation data stored in the operation data storage unit 120 so as to be in a stand-by state.

As described in the above, the present invention can provide various operation orders, since it is possible to perform an urgent operation prior to the currently performing operation when there is an unexpected urgent operation, and to resume the stored previous operation. Furthermore, the invention can provide a higher quality of embroidery, since there is no need to hasten the current embroidery operation because it is possible to carry out an urgent operation first, and the invention is very conducive to an operations management of the embroidery machine operator.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An embroidery machine with an operation-data storing function comprising:

a function-setting means having an operation-data storing key for outputting a signal to store current-operation data as previous-operation data according to user manipulation, and/or an operation data retrieval key for outputting a signal to read the stored previous-operation data;

an operation data storage means for storing data with respect to a previous operation; and a control means for 1) storing the current-operation data as the previous-operation data of the embroidery machine in the operation data storage means when the signal from the function-setting means to store the current-operation data as the previous-operation data is inputted by a user so as to perform another embroidery operation prior to the currently performing operation, and 2) reading the previous-operation data stored in the operation data storage means so as to drive a mechanism means when the signal from the function-setting means to read the previous-operation data is inputted after performing and completing the other embroidery operation.

2. The embroidery machine with an operation-data storing function as recited in claim 1, wherein the previous-operation data stored in the operation data storage means include at least one of a design name of the embroidery operation, a position of the design data in a memory, position data of an embroidery frame, a total stitch number of current operation, and parameter data for driving the mechanism means.

3. A method for controlling an embroidery machine with an operation-data storing function comprising the steps of.

1) storing current-operation data as previous-operation data in an operation data storage means if a signal for storing the current-operation data is inputted according to manipulation of a function-setting means by a user so as to perform another embroidery operation prior to a currently performing operation;

2) performing the other embroidery operation;

3) completing the other embroidery operation;

4) checking whether the previous-operation data is currently being stored in the operation data storage means in response to a signal for reading the previous-operation data when the signal for reading the previous-operation data is inputted according to manipulation of the function-setting means by the user so as to retrieve a previous operation;

5) reading the previous-operation data from the operation data storage means so as to drive the embroidery machine according to operation data when the previous-operation data is being stored in the operation data storage means.

4. The method for controlling an embroidery machine with an operation-data storing function as recited in claim 3, further comprising a step of:

displaying the previous-operation data stored in the storage means in order for a user to view and to select whether to perform the previous operation.

5. The method for controlling an embroidery machine with an operation-data storing function as recited in claim 4, further comprising a step of:

controlling read-out of the previous-operation data from the storage means so as to drive a corresponding mechanism means, if the previous operation is selected to be performed by the user.

6. The method for controlling an embroidery machine with an operation-data storing function as recited in one of the claim claim 4, wherein the corresponding mechanism means is controlled to be driven in accordance with the previous-operation data, if the user manipulates a function-setting means and accordingly an operation start signal is inputted.

7. The method for controlling an embroidery machine with an operation-data storing function as recited in claim 4, wherein the previous-operation data to be stored include at least one of a design name of the embroidery operation, a position of the design data in a memory, position data of an embroidery frame, a total stitch number of current operation, and parameter data for driving the mechanism means.

8. The method for controlling an embroidery machine with an operation-data storing function as recited in claim 7, wherein the previous-operation data to be stored include at least one of a design name of the embroidery operation, a position of the design data in a memory, position data of an embroidery frame, a total stitch number of current operation, and parameter data for driving the mechanism means.

9. A method for controlling an embroidery machine with an operation-data storing function comprising the steps of:

suspending a present embroidery operation in response to a keystroke of an operation-data storing key;

storing data of the present embroidery operation as previous-operation data in an operation data storage means;

performing another embroidery operation;

completing the other embroidery operation;

reading the previous-operation data from the operation data storage means in response to a keystroke of an operation data retrieval key; and restarting the suspended present embroidery operation from a suspended point.

* * * * *